US006854158B2

(12) United States Patent
Fu

(10) Patent No.: US 6,854,158 B2
(45) Date of Patent: Feb. 15, 2005

(54) ERASING DEVICE

(76) Inventor: Mao Jung Fu, 4th Floor, No. 1, lane 4, alley 291, Sec. 1, Sui-yuen Rd., Si-ji, Taipei (TW)

( * ) Notice: Subject to any disclaimer, the term of this patent is extended or adjusted under 35 U.S.C. 154(b) by 301 days.

(21) Appl. No.: 10/114,514

(22) Filed: Apr. 1, 2002

(65) Prior Publication Data

US 2003/0041408 A1 Mar. 6, 2003

(30) Foreign Application Priority Data

Aug. 15, 2001 (TW) ..... 90213976 U

(51) Int. Cl.[7] ..... B43L 19/00
(52) U.S. Cl. ..... 15/433
(58) Field of Search ..... 15/424, 425, 433, 15/434; D19/53

(56) References Cited

U.S. PATENT DOCUMENTS

| | | | | |
|---|---|---|---|---|
| 1,473,090 A | | 11/1923 | Ferry | |
| 1,671,393 A | | 5/1928 | Zantow | |
| 3,049,095 A | * | 8/1962 | Murray | 15/434 |
| 3,072,101 A | | 1/1963 | Kovacs | |
| 3,099,251 A | | 7/1963 | Hertz | |
| 3,495,292 A | * | 2/1970 | Giba et al. | 15/433 |
| 4,352,580 A | | 10/1982 | Ando | |
| 4,899,419 A | | 2/1990 | Saleen | |
| 5,127,130 A | | 7/1992 | Copito | |
| 5,555,602 A | | 9/1996 | Leamond | |
| D386,526 S | | 11/1997 | Ito | |

FOREIGN PATENT DOCUMENTS

| | | | |
|---|---|---|---|
| JP | 10-109498 | * | 4/1998 |
| JP | 10-250289 | * | 9/1998 |

* cited by examiner

*Primary Examiner*—Terrence R. Till
(74) *Attorney, Agent, or Firm*—Garrison & Associates PS; David L. Garrison; William L. Haynes

(57) ABSTRACT

This invention discloses an erasing device that can be held in the same manner as a writing instrument. The eraser is stored in a tube assembly and a rolling mechanism is used to slide the eraser out of the tube assembly for use. The rolling mechanism prevents the eraser from accidentally sliding back into the device during use and gives the user total control over the length of eraser that is extended from the device.

6 Claims, 4 Drawing Sheets

ERASING DEVICE

FIELD OF INVENTION

This invention relates to an erasing device. In particular, this invention relates to a tube assembly that holds an eraser. A roller mechanism is connected to the tube assembly. The roller mechanism functions to hold the eraser in place during use, and can be used for moving the eraser forward as the working end becomes worm. The roller mechanism also functions to move the eraser back into the tube when it is no longer needed.

BACKGROUND OF TH INVENTION

Both mechanical and conventional wood pencils have, for many years, been adapted to provide an attached eraser at the end of the cylindrical pencil barrel opposite that from which the pencil lead extends. Conventional wood pencils typically are provided with a non-renewable and non-adjustable eraser attached by means of a cylindrical band and sized such that the exhaustion of the usable portion of the eraser will coincide with the life of the pencil as it is used and re-sharpened.

Mechanical pencils, on the other hand, have a virtually unlimited life by virtue of replacement pencil leads. As a result, mechanical pencils are sometimes provided with some sort of adjustable eraser mechanism and replacement erasers at the non-writing ends of the pencils. Examples of these eraser adjustment mechanisms can be found in U.S. Pat. Nos. 1,671,393; 3,072,101; 3,099,251; and 4,352,580. Each of the above listed U.S. Patents provides a unique type of adjustment mechanism to facilitate extension of additional portions of an eraser at the non-writing end as it is consumed in normal use.

U.S. Pat. No. 1,473,090, issued to Ferry, discloses a circular sleeved eraser assembly mounted on the outside of a plain lead pencil, through which the writing end of the pencil protrudes, and which places the eraser in close proximity to the lead point. A sliding of the assembly forward places the eraser segment at, and beyond the lead point of the pencil for erasure of written material.

This eraser assembly suffers several disadvantages: the assembly at the writing end unbalances the pencil, obscures the point of the pencil and the written material, is subject to relatively easy loss or mislocation, and is a meaningful obstruction to placement in a pocket. U.S. Pat. No. 4,899,419, issued to Saleen, discloses a circular, sleeved eraser assembly for use with a mechanical pencil, similar in intent to that of the Ferry patent, and suffers the same several disadvantages noted above.

U.S. Pat No. 5,127,130, issued to Copito, discloses an eraser in the shape and form of a cowling sleeve affixed to the front end of either a double acting mechanical pencil or single acting ball point pen. To use this eraser, the user must flatten the angle of the writing implement. As the eraser becomes worm, the user must increase the angle of the writing instrument while erasing, which decreases the ergonomic efficiency of the eraser. Additionally, when replacing the eraser cowling, the user could potentially loose control of the spring thereby loosing it and rendering the writing instrument inoperable.

U.S. Pat. No. 5,555,602, issued to Leamnond, discloses an eraser that is placed on the writing end of a writing instrument. At least one eraser arm extends radially outward from the finger grip section and angled forward towards the front end of the writing instrument so that a user can use the eraser by tilting and rotating the finger grip section to bring the eraser into contact with a writing surface. This type of eraser suffers the same ergonomic disadvantages as the eraser disclosed in the Copito patent in that a user must increase the angle of the writing instrument as the eraser becomes worn.

There are also several devices commercially available that do not incorporate the eraser and writing utensil into one instrument. While these devices are more ergonomic than the patented devices described above, several disadvantages still exist. One of these devices is designed so that a cylindrical eraser is tightly wrapped with paper, in a manner similar to a grease pencil. When a user desires to erase something, he or she must tear off a small portion of the paper that is wrapped around the eraser. However, when the eraser is no longer needed, it cannot be put back into the wrapper.

Another commercially available erasing device functions like a pen with a spring. The user pushes down the cap of the device, which triggers the spring causing the eraser to slide out of the tube. When this device is not in use, the user can push the cap down and slide the eraser back into the tube. While this device is an improvement over previous erasing devices, it is difficult to control the length of eraser that slides out of the tube when the cap is pushed, and the eraser is easily pushed back into the tube while in use.

A third commercially available device is an eraser inserted into a tube with a graduated slot on one side of the tube. The user moves the eraser out of the tube by pushing down on the eraser. The distance between the graduations fixes the distance the eraser slides out of the tube, and this can cause too much eraser to be out of the tube, which can lead to waste due to eraser breakage.

None of the above listed devices provide maximum convenience to the user by providing for a natural ergonomic holding position while providing total control of the eraser. Therefore, an ergonomically designed eraser that will allow users to always hold the eraser in the same easy and relaxing way while giving them total control over the length of the eraser and preventing the eraser from accidentally being pushed back into its holder is desired.

DISCLOSURE OF THE INVENTION

Accordingly it is an object of this invention to provide an ergonomically designed eraser that will allow users to always hold the eraser in the same easy and relaxing way.

It is a further object of this invention to provide an eraser that gives users total control over the length of the eraser that extends from the erasing device.

Another object of this invention is to provide an erasing device that prevents the eraser from accidentally being pushed back into the assembly during use.

A further object of this invention is to provide an erasing device that can be used with different shapes of erasers.

Yet another object of this invention is to provide such assemblies that are inexpensive and simple to manufacture.

These objects are accomplished by providing an ergonomic adjustable erasing device that gives the user total control over the length of eraser that is extended from the device and prevents the eraser from accidentally being pushed back into the device. A preferred embodiment of this invention has an eraser housed inside a pair of threaded tubes that are attached to each other. The front tube includes a slot that communicates from the exterior surface of the tube into the eraser channel. A rough surfaced rolling mechanism is placed in the slot and rotatably attached to the front tube.

The diameter of the wheel is sufficiently large that the distance from the outer surface of the rolling mechanism and the interior surface of the eraser channel, opposite the slot, is slightly smaller than the thickness of the eraser.

According to the teachings of this invention, when a person wishes to use the eraser he or she simply rotates the rolling mechanism, toward the rear tube, about its pivot point. The rough surface of the rolling mechanism grabs the eraser and forces the eraser out of the front tube. The user extends the eraser the desired-distance and then begins to erase. Because the distance between the surface of the rolling mechanism and the interior wall of the eraser channel, opposite the surface of the rolling mechanism, is smaller than the thickness of the eraser, the eraser is prevented from being accidentally pushed back into the tube. When the user is done erasing, he or she simply rotates the rolling mechanism in the opposite direction, and the eraser is forced back into the tube.

Because the erasing device is similar in shape to a pencil or pen, it allows the user to grip the device in a more natural position, thereby allowing for even pressure when using the device. This allows users to complete the task of erasing efficiently. Additionally, because the distance between the surface of the rolling mechanism and the interior surface of the eraser channel is smaller than the thickness of the eraser, the eraser can be designed into different shapes in terms of its cross section (square, circle, hexagon, etc.).

BEST MODE OF CARRYING OUT THE INVENTION

Figure 1:
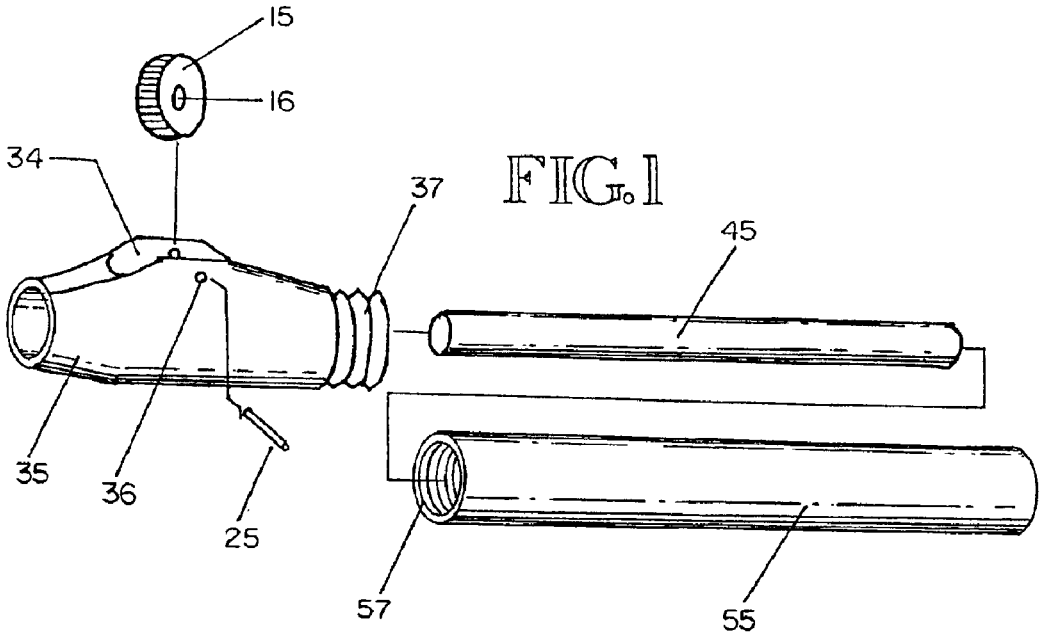
FIG. 1 is an exploded view showing all parts of the erasing device of this invention.

Turning now to the drawings, the invention will be described in preferred embodiments by reference to the numerals of the drawing figures wherein like numbers indicate like parts.

FIG. 1 shows all of the parts of a preferred embodiment of this invention. The front tube 35 has a first and second end with an eraser channel running therethrough. The second end of the front tube 35 further has threads 37 which match threads 57 on the rear tube 55.

The front tube 35 has a generally trapezoidal shaped bulge on one side of the tube 35. Rolling mechanism slot 34 communicates from the outer surface of the trapezoidal shaped bulge on front tube 35 into the eraser channel. Connection pin holes 36 communicate through the trapezoidal shaped bulge on either side of the rolling mechanism slot 34.

Rolling mechanism 15 is generally disk shaped, and includes a rough textured surface on the circumference of the disk. Rolling mechanism 15 further includes a hole 16 that communicates through the center of the rolling mechanism 15.

The device is assembled by aligning the hole 16 in the rolling mechanism l5 with connection pin holes 36, connection pin 25 is then inserted through the aligned holes. Eraser 45 is inserted into the eraser channel of the front tube 35 until it makes contact with the rolling mechanism 15. The rolling mechanism 15 is then rotated so that it grips the eraser and forces it further into the eraser channel. The rear tube 55 is then place over the eraser 45 and threadedly attached to the front tube 35. The eraser is stored in the storage channel in the rear tube.

In the embodiment depicted, connection pin holes 36 are the same diameter as connection pin 25. However, in other embodiments of the invention one of the connection pin holes can be threaded and the connection pin can have threads at one end. The non-threaded connection pin hole is large enough so that the threads on the connection pin can slide easily through the non-threaded connection pin hole.

Figure 2:
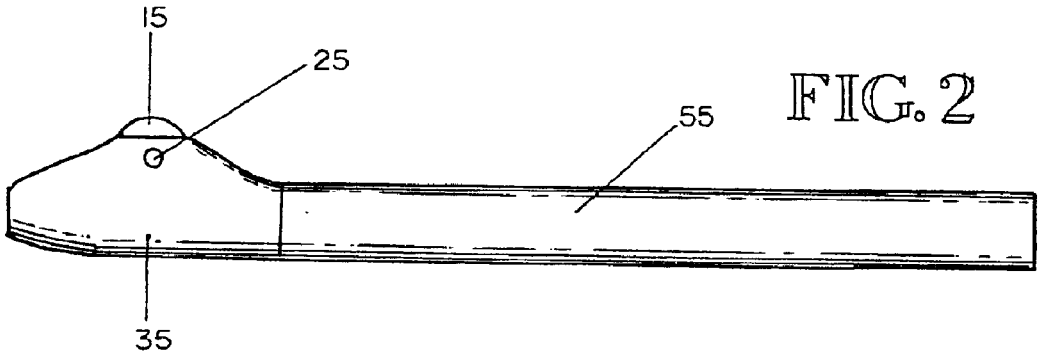
FIG. 2 is a full-length side elevation view of the invention.

FIG. 2 shows the eraser device of this invention in its assembled state. A user desiring to use the eraser 45 would rotate the rolling mechanism 15 until the eraser 45 protrudes from the front tube 35. The. user can control the distance that the eraser 45 protrudes, and the rolling mechanism 15 prevents the eraser from being accidentally pushed back into the erasing device.

Figure 3:
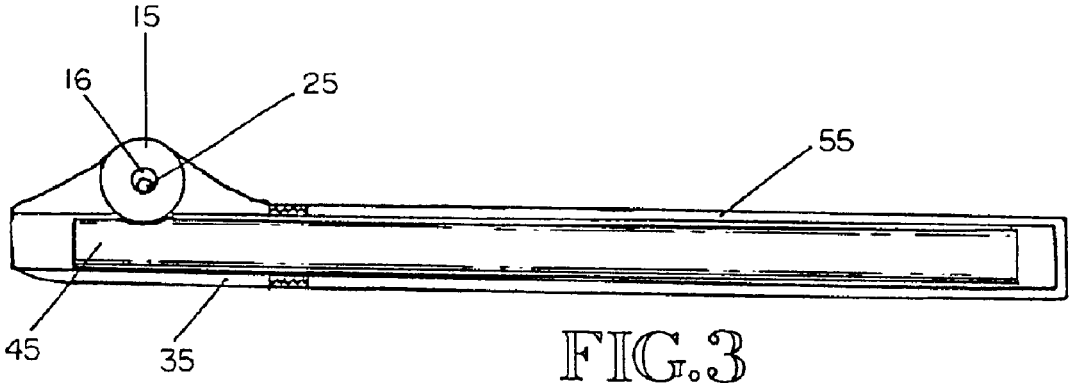
FIG. 3 is a cross-sectional view of the invention.

FIG. 3 shows a cross-sectional view of one embodiment of the erasing device of this invention. The working end of the eraser 45 is in the eraser channel of the front tube 35, while the remainder of the eraser is in the storage channel of the rear tube 55. The rolling mechanism 15 protrudes into the eraser channel through the rolling mechanism slot. The rolling mechanism 15 is used to move the working end of the eraser 45 out of the first end of the front tube 35.

In the embodiment depicted, the diameter of the hole 16 in the rolling mechanism 15 is slightly larger than the diameter of the connection pin 25 such that the pin does not fit tightly in the rolling mechanism. As can be seen in the drawing figures, the hole is larger than it would need to be if it were simply larger for the sole reason of allowing the pin to be placed through the hole in the rolling mechanism. By making the diameter of the hole 16 slightly larger than the diameter of the connection pin 25, the pressure and friction between the rolling mechanism 15 and the eraser 45 can be moderated by the user putting generally downward pressure on the rolling mechanism 15.

Figure 4:
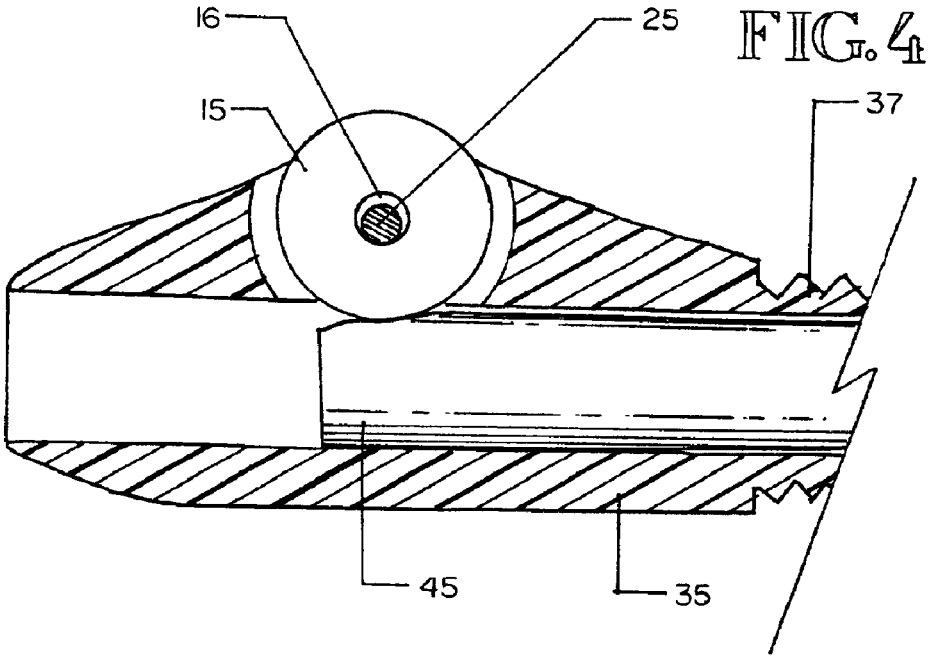
FIG. 4 is a detailed cross-sectional view that shows the rolling mechanism of this invention.

FIG. 4 is a more detailed cross-sectional view of the front tube 35 the rolling mechanism 15 and the eraser 45. The distance between the surface of the rolling mechanism and the surface of the eraser cavity opposite the rolling mechanism slot is slightly smaller than the thickness of the eraser 45. Because the eraser 45 is slightly thicker than the gap between the wall of the eraser channel and the rolling mechanism 15, the eraser will remain in position until the user rotates the rolling mechanism 15 to move the eraser 45.

Figure 5:
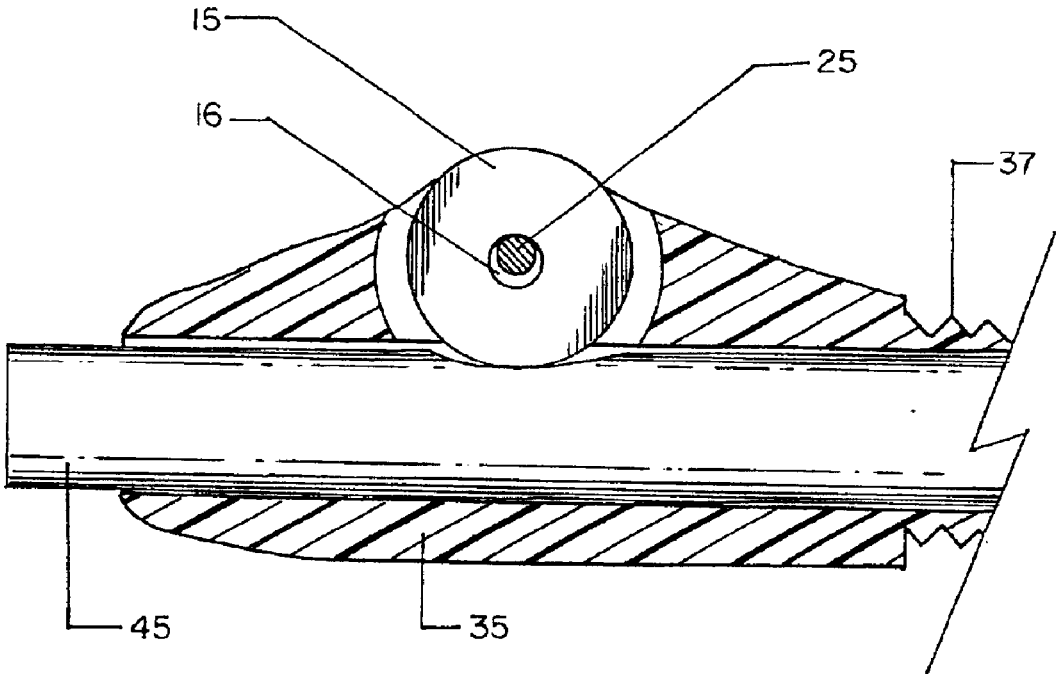
FIG. 5 is a detailed cross-sectional view of the rolling mechanism that shows the eraser extended from the erasing device of this invention.

FIG. 5 is a cross-sectional view of the same embodiment of the invention as depicted in FIG. 4, with the eraser 45 extended out of the first end of the front tube 35. To further prevent the eraser 45 from accidentally sliding back into the device while it is in use, a user can place light pressure on the rolling mechanism 15 and effectively lock the eraser 45 in the extended position.

The erasing device of this invention is ergonomically efficient in that it allows a user to hold the device in the same manner as he or she would hold a writing instrument. The rolling mechanism prevents the eraser from accidentally sliding out of the tube when the device is not in use, this allows the user total control over the length of eraser that is extended from the device, and prevents the eraser from accidentally sliding back into the device while it is in use.

Figure 6:
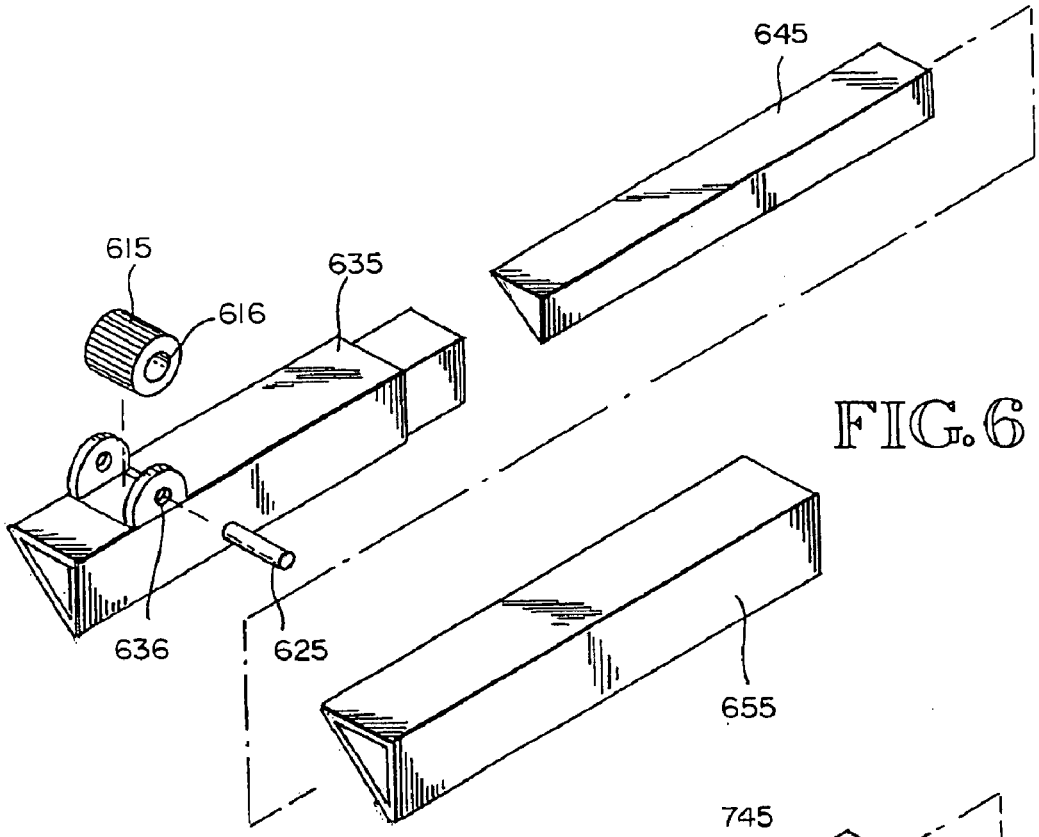
FIG. 6 is an exploded view showing an embodiment of the invention wherein the eraser has a triangular shaped cross section along its length.

The device can be constructed inexpensively from suitable materials. The device can be made in a variety of colors. The cross-sectional shape of the eraser can be selected from a plurality of geometric shapes, and the eraser can be made in a variety of colors. FIG. 6 shows an embodiment of the current invention wherein the device and the eraser have a generally triangular cross section along the length of the device. A front tube 635 has a first and second end with an eraser channel running therethrough. An eraser 645 is insertable into the front tube the eraser channel of a rear tube 655. A rolling mechanism 615 is held in place by a pin 625 that is placed through pin holes 636 and through a hole 616 in the rolling mechanism.

Figure 7:
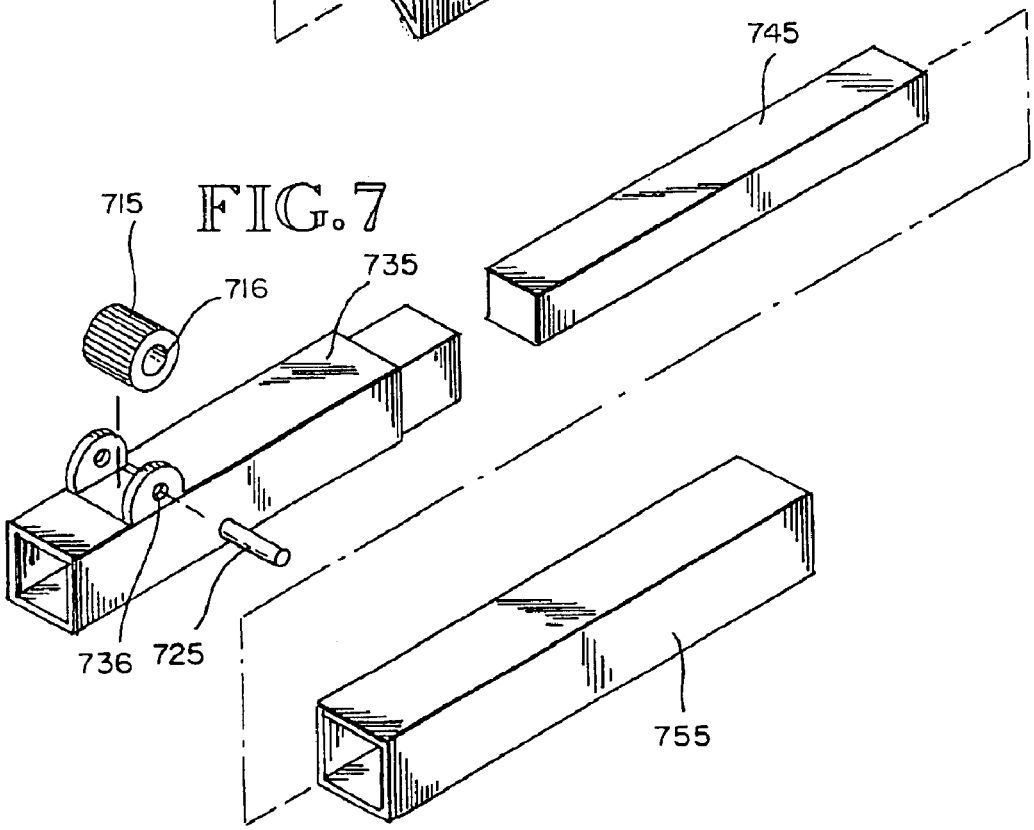
FIG. 7 is an exploded view showing an embodiment of the invention wherein the eraser has a square shaped cross section along its length.

FIG. 7 shows an embodiment of the current invention wherein the device and the eraser have a generally square cross section along the length of the device. A front tube 735 has a first and second end with an eraser channel running therethrough. An eraser 745 is insertable into the front tube the eraser channel of a rear tube 755. A rolling mechanism 715 is held in place by a pin 725 that is placed through pin holes 736 and through a hole 716 in the rolling mechanism.

INDUSTRIAL APPLICABILITY

The invention has applicability to the field of erasing devices, in particular, this invention describes an erasing device that can be used while holding it in a manner similar to a writing implement. The length of eraser that protrudes from the device is controlled through the use of a rolling mechanism, and the mechanism also prevents the eraser from being accidentally pushed back into the device while it is in use.

In compliance with the statute, the invention has been described in language more or less specific as to structural features. It is to be understood, however, that the invention is not limited to the specific features shown or described, since the means and construction shown or described comprise preferred forms of putting the invention into effect, and it will be readily apparent to those skilled in the art that the invention can be adapted to other uses as well. The invention is, therefore, claimed in any of its forms or modifications within the legitimate and valid scope of the appended claims, appropriately interpreted in accordance with the doctrine of equivalents.

What is claimed is:

1. An erasing device comprising: a front tube, a rear tube, a rolling mechanism, a connection pin and an eraser;

said front tube having a first end, a second end, and a longitudinal eraser channel therethrough;

said front tube further having a generally trapezoidal shaped bulge on one side of said front tube, a rolling mechanism slot that communicates from the outer surface of said generally trapezoidal shaped bulge to said longitudinal eraser channel, and two connection pinholes that communicate through said generally trapezoidal shaped bulge on either side of said rolling mechanism slot at a right angle to said longitudinal eraser channel;

each of said two connection pin holes having a diameter equal to the diameter of said connection pin;

said rolling mechanism being generally disk shaped and having a rough textured surface around the circumference of said rolling mechanism;

said rolling mechanism further having a hole communicating through the center of said rolling mechanism that is slightly larger than said connection pin such that said connection pin will not fit tightly in said hole in the rolling mechanism;

said rolling mechanism being rotatably connected to said front tube by placing said connection pin through one of said two connection pin holes, through said hole in said center of said rolling mechanism and into said other of said connection pin holes, such that said rolling mechanism is loosely retained in said rolling mechanism slot and protrudes into said longitudinal eraser channel;

said rear tube having a connection end, a back end, and a longitudinal storage channel therethrough;

said eraser being slightly shorter than the combined length of said front tube and said rear tube and thin enough to slide easily into said longitudinal eraser channel and said longitudinal storage channel;

the distance between said rough textured surface on said circumference of said rolling mechanism and the wall of said longitudinal eraser channel being slightly less than the thickness of said eraser;

whereby said eraser is placed into said longitudinal eraser channel and said rolling mechanism is rotated such that said rough textured surface grips said eraser and forces said eraser toward said first end of said front tube, said connection end of said rear tube is then placed over said eraser and removably connected to said second end of said front tube thereby allowing a user of said erasing device to moderate the pressure and friction between the rolling mechanism and the eraser by exerting or releasing pressure on the rolling mechanism and thereby control the length of eraser that protrudes from said first end of said front tube by rotating the rolling mechanism; and prevent said eraser from accidentally being pushed back into said erasing device while said eraser is in use.

2. The erasing device of claim 1 wherein said second end of said front tube and said connection end of said rear tube are threaded such that said front tube and said rear tube can be threadedly connected.

3. The erasing device of claim 1 wherein the cross-sectional shape of said eraser is selected from the group of geometric shapes consisting of circle, triangle, and square.

4. An erasing device comprising: a front tube, a rear tube, a rolling mechanism, a connection pin and an eraser;

said front tube having a first end, a second end, and a longitudinal eraser channel therethrough;

said front tube further having a generally trapezoidal shaped bulge on one side of said front tube, a rolling mechanism slot that communicates from the outer surface of said generally trapezoidal shaped bulge to said longitudinal eraser channel, and two connection pinholes that communicate through said generally trapezoidal shaped bulge on either side of said rolling mechanism slot at a right angle to said longitudinal eraser channel;

each of said two connection pin holes having a diameter equal to the diameter of said connection pin;

said rolling mechanism being generally disk shaped and having a rough textured surface around the circumference of said rolling mechanism;

said rolling mechanism further having a hole communicating through the center of said rolling mechanism, and said hole having a diameter slightly larger than said diameter of said connection pin such that said connection pin will not fit tightly in said hole in the rolling mechanism;

said rolling mechanism being rotatably connected to said front tube by placing said connection pin through one of said two connection pin holes, through said hole in said center of said rolling mechanism and into said other of said connection pin holes, such that said rolling mechanism is loosely retained in said rolling mechanism slot and protrudes into said longitudinal eraser channel;

said rear tube having a connection end, a back end, and a longitudinal storage channel therethrough;

said second end of said front tube and said connection end of said rear tube being threaded such that said front tube and said rear tube can be threadedly connected;

said eraser having the same cross-sectional shape along its length as the general cross-sectional shape of said front tube and said rear tube and further being slightly shorter than the combined length of said front tube and said rear tube and thin enough to slide easily into said longitudinal eraser channel and said longitudinal storage channel;

the distance between said rough textured surface on said circumference of said rolling mechanism and the wall of said longitudinal eraser channel being slightly less than the thickness of said eraser;

whereby said eraser is placed into said longitudinal eraser channel and said rolling mechanism is rotated such that said rough textured surface grips said eraser and forces said eraser toward said first end of said front tube, said connection end of said rear tube is then placed over said eraser and removably connected to said second end of said front tube thereby allowing a user of said erasing device to moderate the pressure and friction between the rolling mechanism and the eraser by exerting or releasing pressure on the rolling mechanism and thereby control the length of eraser that protrudes from said first end of said front tube by rotating the rolling mechanism; and prevent said eraser from accidentally being pushed back into said erasing device while said eraser is in use.

5. The erasing device of claim 4 wherein the cross-sectional shape of said eraser is selected from the group of geometric shapes consisting of circle, triangle, and square.

6. An erasing device comprising: a front tube, a rear tube, a rolling mechanism, a connection pin and an eraser;

said front tube having a first end, a second end, and a longitudinal eraser channel therethrough;

said front tube further having a generally trapezoidal shaped bulge on one side of said front tube, a rolling mechanism slot that communicates from the outer surface of said generally trapezoidal shaped bulge to said longitudinal eraser channel, and two connection pinholes that communicate through said generally trapezoidal shaped bulge on either side of said rolling mechanism slot at a right angle to said longitudinal eraser channel;

each of said two connection pin holes having a diameter equal to the diameter of said connection pin;

said rolling mechanism being generally disk shaped and having a rough textured surface around the circumference of said rolling mechanism;

said rolling mechanism further having a hole communicating through the center of said rolling mechanism, and said hole having a diameter slightly larger than said diameter of said connection pin such that said connection pin will not fit tightly in said hole in the rolling mechanism;

said rolling mechanism being rotatably connected to said front tube by placing said connection pin through one of said two connection pin holes, through said hole in said center of said rolling mechanism and into said other of said connection pin holes, such that said rolling mechanism is loosely retained in said rolling mechanism slot and protrudes into said longitudinal eraser channel;

said rear tube having a connection end, a back end, and a longitudinal storage channel therethrough;

said eraser having a cross-sectional shape that is selected from the group of geometric shapes consisting of circle, triangle, and square;

said eraser being slightly shorter than the combined length of said front tube and said rear tube and thin enough to slide easily into said longitudinal eraser channel and said longitudinal storage channel;

the distance between said rough textured surface on said circumference of said rolling mechanism and the wall of said longitudinal eraser channel being slightly less than the thickness of said eraser;

whereby said eraser is placed into said longitudinal eraser channel and said rolling mechanism is rotated such that said rough textured surface grips said eraser and forces said eraser toward said first end of said front tube, said connection end of said rear tube is then placed over said eraser and threadedly connected to said second end of said front tube thereby allowing a user of said erasing device to moderate the pressure and friction between the rolling mechanism and the eraser by exerting or releasing pressure on the rolling mechanism and thereby control the length of eraser that protrudes from said first end of said front tube by rotating the rolling mechanism; and prevent said eraser from accidentally being pushed back into said erasing device while said eraser is in use.

* * * * *